US005426908A

United States Patent [19]

Shayman

[11] Patent Number: 5,426,908

[45] Date of Patent: Jun. 27, 1995

[54] METHOD OF CONSTRUCTION USING CORRUGATED MATERIAL

[76] Inventor: Harry I. Shayman, 175 N. Harbor Dr., Apt. 5405, Chicago, Ill. 60601

[21] Appl. No.: 199,590

[22] Filed: Feb. 22, 1994

[51] Int. Cl.[6] ..... E04C 2/32

[52] U.S. Cl. ..... 52/795; 52/51.1; 52/270; 52/309.8; 52/407.3; 52/799; 52/811; 52/745.19; 428/537.7; 428/703

[58] Field of Search ..... 428/537.7, 703; 52/309.8, 811, 407.2, 407.3, 270, 91.3, 799, 802, 91.1, 745.19

[56] References Cited

U.S. PATENT DOCUMENTS

| | | | |
|---|---|---|---|
| 1,760,817 | 5/1930 | Creamer et al. . | |
| 2,238,022 | 4/1941 | Johnson . | |
| 2,330,941 | 10/1943 | Acuff, Jr. | 52/799 |
| 2,336,435 | 12/1943 | Zirinsky . | |
| 3,051,277 | 8/1962 | Day, Jr. . | |
| 3,368,473 | 2/1964 | Sohda et al. | 52/799 |
| 3,457,698 | 7/1969 | Albers . | |
| 3,482,367 | 12/1969 | Curran . | |
| 3,517,468 | 6/1970 | Woods . | |
| 3,555,756 | 1/1971 | Curran et al. . | |
| 3,747,290 | 2/1973 | Barrell et al. | 52/91.1 |
| 3,800,485 | 4/1974 | Yates | 52/91.1 |
| 3,803,786 | 4/1974 | Schneider | 52/91.1 |
| 3,883,999 | 5/1975 | Nicoll, Jr. | 52/91.1 |
| 3,908,062 | 9/1975 | Roberts | 428/537.7 |
| 3,955,031 | 5/1976 | Jones et al. | 428/537.7 |
| 4,081,938 | 4/1978 | Bertacchi et al. . | |
| 4,120,131 | 10/1978 | Carroll . | |
| 4,227,356 | 10/1980 | Stern et al. . | |
| 4,263,752 | 4/1981 | Jungbluth | 52/799 |
| 4,274,239 | 6/1981 | Carroll . | |
| 4,351,870 | 9/1982 | English, Jr. . | |
| 4,434,592 | 3/1984 | Reneault et al. . | |
| 4,463,043 | 7/1984 | Reeves et al. . | |
| 4,736,566 | 4/1988 | Krotsch . | |
| 4,832,308 | 5/1989 | Slonimsky et al. | 52/799 |
| 5,256,467 | 10/1993 | Kato | 52/799 |
| 5,309,690 | 5/1994 | Symons . | |

FOREIGN PATENT DOCUMENTS

| | | |
|---|---|---|
| 2194242 | 7/1990 | Japan . |

*Primary Examiner*—Carl D. Friedman
*Assistant Examiner*—Christopher Todd Kent
*Attorney, Agent, or Firm*—Patula & Associates

[57] ABSTRACT

A pre-fabricated building section made up of gypsum board laminated to either a double or triple layer of a length of U- or C-shaped corrugated cardboard in approximately two foot widths. The completed sections are then used in homes or building constructions. Within the shaped cardboard is a sheet of fireproof foam. Metal stays bolted in place at the ends and corners of corrugated cardboard, used to attach adjacent sections, assist in the rigidity of the resulting section.

10 Claims, 4 Drawing Sheets

Fig 6
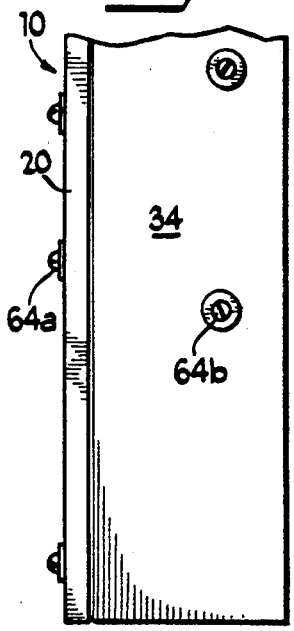
Fig 7
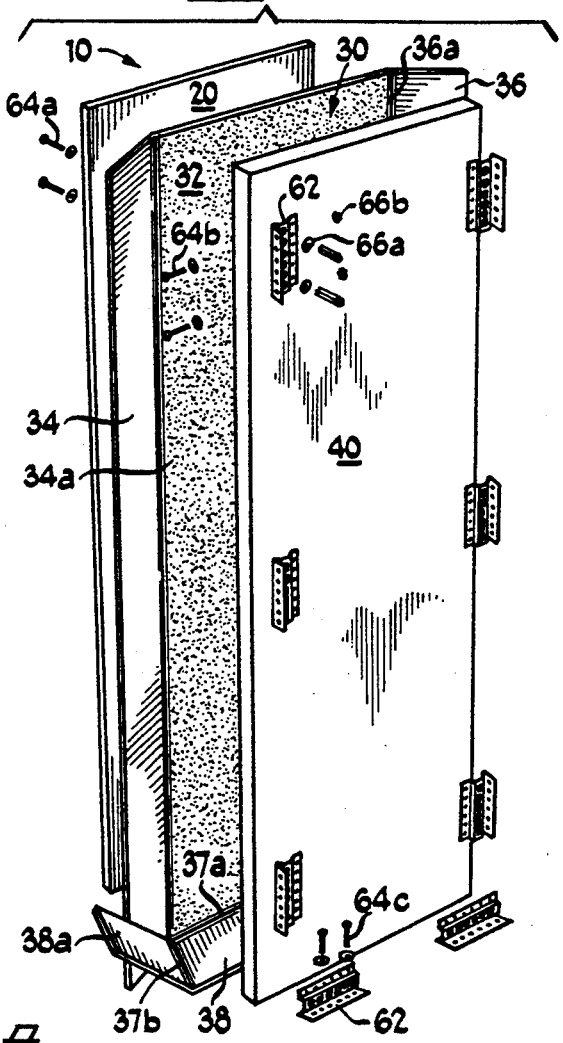
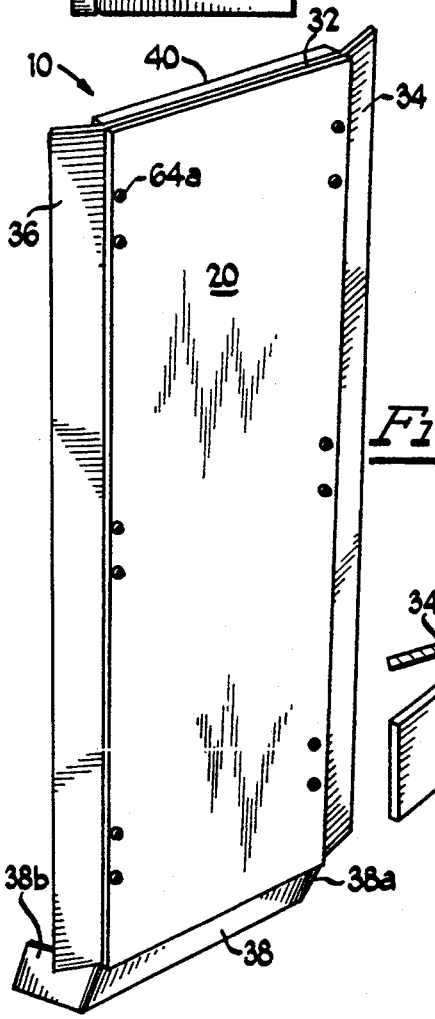
Fig 8
Fig 9
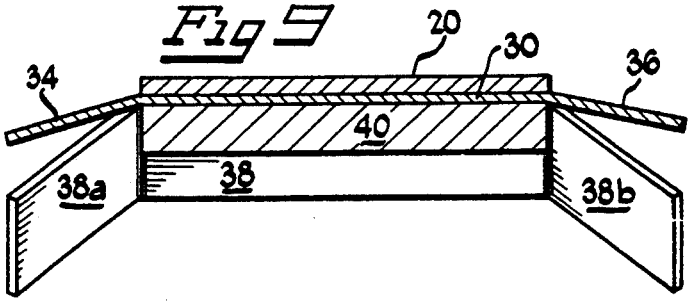

METHOD OF CONSTRUCTION USING CORRUGATED MATERIAL

The present invention relates generally to construction material and a method of construction and, in particular, a quick and inexpensive method of construction using corrugated material.

BACKGROUND OF THE INVENTION

The need to quickly construct inexpensive structures such as homes or other types of buildings is ever present. Further, these structures must be soundly built to accommodate the forces of nature including natural disasters and/or man-made disasters such as a fire. For example, should a natural disaster such as a hurricane strike, hundreds or thousands of people might be left without housing. This situation is magnified if such a disaster occurs in a poorer section of the world where many of the people would not have the means necessary to quickly rebuild or relocate. Therefore, there is a need to have numerous housing structures, whether temporary or permanent, to be built in a quick, efficient and inexpensive manner.

Further, these structures must be strong and secure such that they may be lived in safely and permanently if needed or desired. Accordingly, there is a need for a strong, relatively lightweight, inexpensive, fireproof and easy to assemble construction material and method of construction. Prior art construction material and systems have failed to adequately meet these needs.

U.S. Pat. No. 5,088,259 issued to Myers discloses a roof construction system. Myers differs from the present invention in that the roof construction system comprises a metal roof deck to which a thin waterproof membrane, a foam insulation, and another water impervious membrane are attached. Myers does not disclose a quick and inexpensive method of construction using corrugated material as does the present invention.

U.S. Pat. No. 4,052,828 issued to Mancini, et al. discloses a structural member used as a wall between a ceiling and a floor. Mancini, et al. differs from the present invention in that the wall comprises an accordion-like cardboard core sandwiched between two dry wall boards and utilizes an inverted U-channel to support the wall at its upper end, and a complicated two component support member at its lower end. Mancini, et al. does not disclose a quick and inexpensive method of construction using corrugated material as does the present invention.

U.S. Pat. No. 3,031,044 issued to Stitt, et al. discloses a fire retardant wall construction. Stitt, et al. differs from the present invention in that the wall comprises two sets of spaced apart panels between which are arranged four panels of fire retardant material and utilizes a complicated clip mechanism to attach the structure. Stitt, et al. does not disclose a quick and inexpensive method of construction using corrugated material as does the present invention.

U.S. Pat. No. 683,060 issued to New discloses an insulating construction. New differs from the present invention in that the insulating construction comprises a wooden block having a plurality of partitions therein spread or separated by air-spaces. New does not disclose a quick and inexpensive method of construction using corrugated material as does the present invention.

U.S. Pat. No. 3,192,099 issued to Beckman, et al. discloses a furniture panel. Beckman, et al. differs from the present invention in that the furniture panel comprises a corrugated, foam sandwich core enclosed by a jacket having a decorative exterior. Beckman, et al. does not disclose a quick and inexpensive method of construction using corrugated material as does the present invention.

U.S. Pat. Nos. 5,215,806 and 5,032,447 issued to Bailey disclose a fire barrier material for use in building construction. Bailey differs from the present invention in that the fire barrier material is used in conjunction with wall, ceiling or floor expansion joint systems. Bailey does not disclose a quick and inexpensive method of construction using corrugated material as does the present invention.

U.S. Pat. No. 897,158 issued to Ryan discloses a plaster board. Ryan differs from the present invention in that the plaster board comprises of a layer of plaster of paris, a sheet of coarse burlap, a second plaster layer and a second sheet of burlap to which asbestos is applied. Ryan does not disclose a quick and inexpensive method of construction using corrugated material as does the present invention.

SUMMARY OF THE INVENTION

The present invention relates to the manufacture of a prefabricated building section. The section is made of gypsum board laminated to either a double or triple layer of a length of U- or C-shaped corrugated cardboard in approximately two foot widths. The completed sections are then used in home or building constructions.

Within the shaped cardboard is a sheet of fireproof foam. Metal stays bolted in place at the ends and corners of the corrugated cardboard, used to attach sections together, assist in the rigidity of the resulting section.

In a first embodiment, the section is made up of a outer layer of gypsum board laminated to a layer of corrugated and a layer of fireproof or fire resistant foam laminated to the layer of corrugated. The sides of the corrugated fold inward to form the structural studs of the section.

In a second embodiment, the outer layer of gypsum board is laminated to a layer of corrugated followed by a layer of foam followed by an additional layer of corrugated. The ends of each layer of corrugated fold outward to form the structural studs of this section. The sections are fastened together at the structural studs.

Accordingly, it is an object of the present invention to provide construction material and a method of construction using corrugated material.

It is another object of the present invention to provide a pre-fabricated building section which can be quickly and inexpensively used to construct or form a structure.

It is an additional object of the present invention to provide a building section which is strong and secure with which a structure can be constructed solely out of the material of the pre-fabricated building sections.

It is a further object of the present invention to provide a fireproof building section using corrugated material.

It is yet another object of the present invention to provide a method of constructing utilizing pre-fabricated building sections containing corrugated material.

BRIEF DESCRIPTION OF THE DRAWINGS

A fuller understanding of the foregoing may be had by reference to the accompanying drawings wherein:

FIG. 6 is a partial side elevational view of a section;

FIG. 7 is an exploded perspective view of a section as seen from the inside surface;

FIG. 8 is a partially assembled perspective view of a pre-fabricated section as seen from the outside surface;

FIG. 9 a top view of a section as seen in FIG. 8;

DETAILED DESCRIPTION OF THE EMBODIMENT

Figure 1:
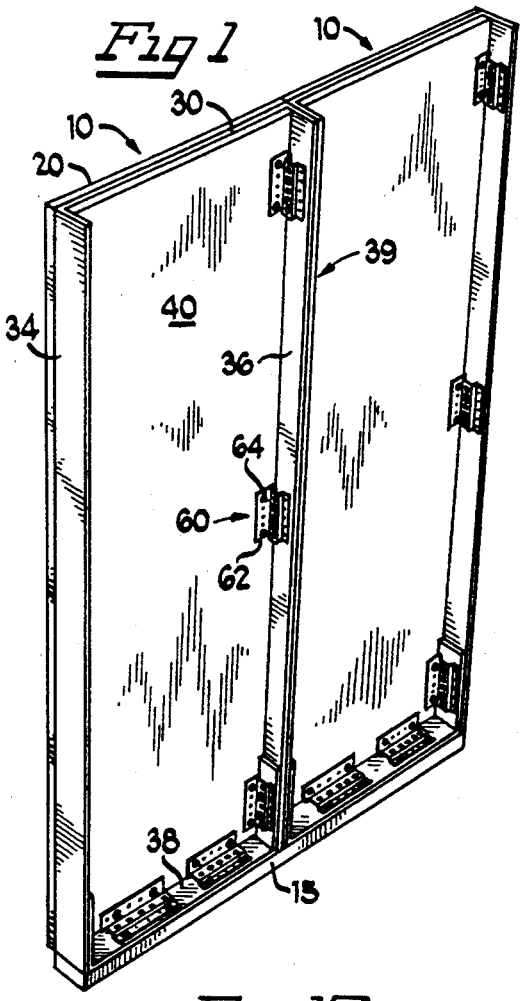
FIG. 1 is a perspective view of two sections of the present invention mounted together showing the inside portions of the sections.

While the invention is susceptible of embodiment in many different forms, there is shown in the drawings and will be described herein in detail, a preferred and alternate embodiment of the present invention. It should be understood, however, that the present disclosure is to be considered an exemplification of the principles of the invention and is not intended to limit the spirit and scope of the invention and/or claims of the embodiments illustrated.

FIGS. 1–12 illustrate generally a preferred embodiment of the present invention. Building section 10 is comprised of an outer layer of gypsum board 20 laminated to a middle layer of corrugated 30 which is laminated to an inner layer of fire resistant foam 40. Completed sections are fastened together by fasteners 60 comprised of metal stays 62 and bolts 64.

Figure 13:
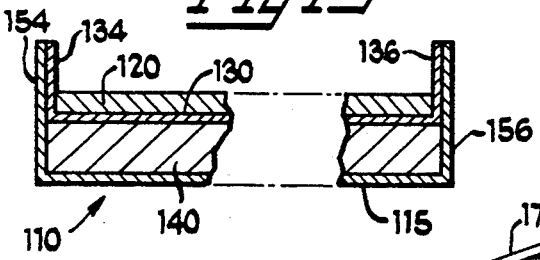
FIG. 13 is a broken cross-sectional view of a second embodiment of the present invention.
Figure 14:
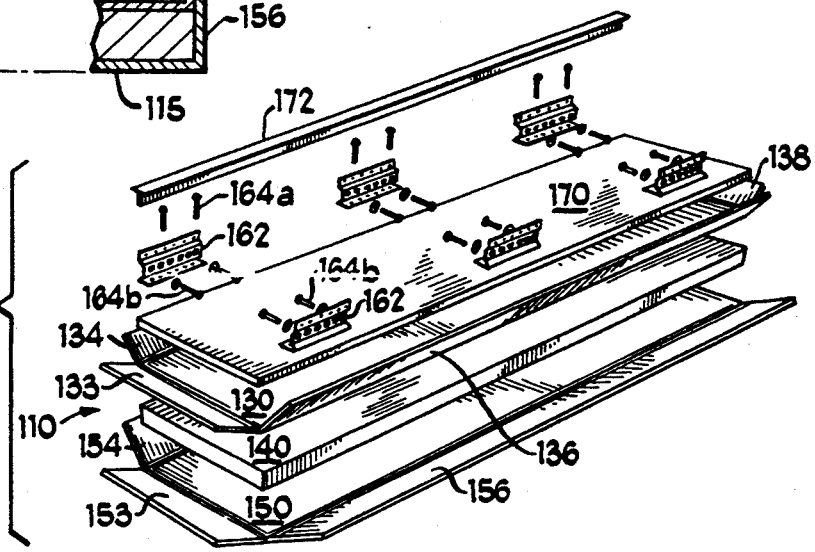
FIG. 14 is an exploded perspective view of the embodiment of FIG. 13.

FIGS. 13–14 illustrate generally a second embodiment of the present invention. Building section 110 is comprised of an outer layer of gypsum board 120 laminated to a middle layer of corrugated 130, which is laminated to a layer of foam 140, which is laminated to an outer layer of corrugated 150. The completed sections are bolted together by fasteners 160 comprised of metal stays 162 and bolts 164.

Referring now to FIG. 1, building sections 10 are shown in their assembled form mounted to each other and forming a structural section such as a wall. As can be seen in FIG. 1, building section 10 comprises an outer layer of gypsum board 20 laminated or glued to a middle layer of corrugated 30, which is laminated or glued to an inner layer of fireproof foam 40. Foam layer 40 provides rigidity and insulation to the section 10. Middle layer of corrugated 30 includes the main planar section 32, (see FIG. 2), two-side flaps 34, 36, and bottom flap 38. Side flaps are folded inward around inside foam layer 40 to form the section sides. Two section sides are mounted together to from a section stud 39. Bottom flap 38 is folded inward and upward to from the bottom of section 10. Section 10 is held in its assembled position by fasteners 60, such as angled metal stays 62 and bolts 64. Section 10 is shown mounted on building base support 15.

Figure 2:
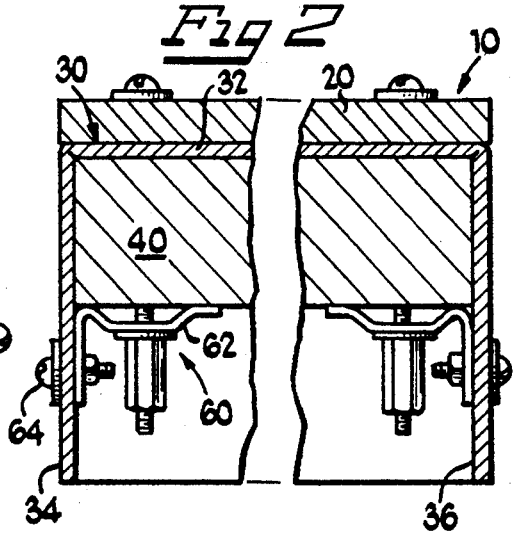
FIG. 2 is a broken top sectional view of a section.

FIG. 2 shows a broken top view of section 10 comprising outer layer of gypsum board 20, middle layer of corrugated 30, and inner layer of foam 40 laminated together and secured by fasteners 60. As can be seen, side flaps 34 and 36 are mounted in assembled position perpendicular to outer layer of gypsum board 20, main planar section of corrugated 32 and foam layer 40 by angled metal stays 62 and side bolt **64*b*. Layer of gypsum 20 main planar section of corrugated 32 and layer foam 40 are laminated and bolted together by angled metal stays 62 and elongated bolts 64*a*. Bolts 64 are attached by nuts 66**.

Figure 3:
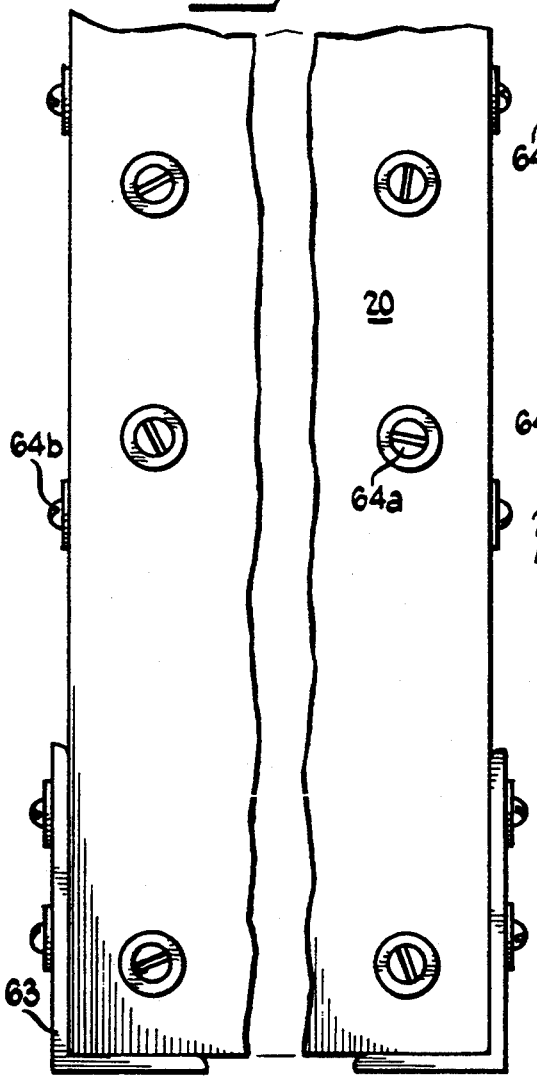
FIG. 3 is a broken front view of a section showing the outside surface of a section.

FIG. 3 a front view of section 10 as seen from the outside surface of the sections. Outer layer of gypsum board 20 is shown having elongated bolts **64*a* mounted therein. Further, side bolt 64*b* are seen holding section 10 in its assembled position. Section 10 is shown mounted to angled metal brackets 63**.

Figure 4:
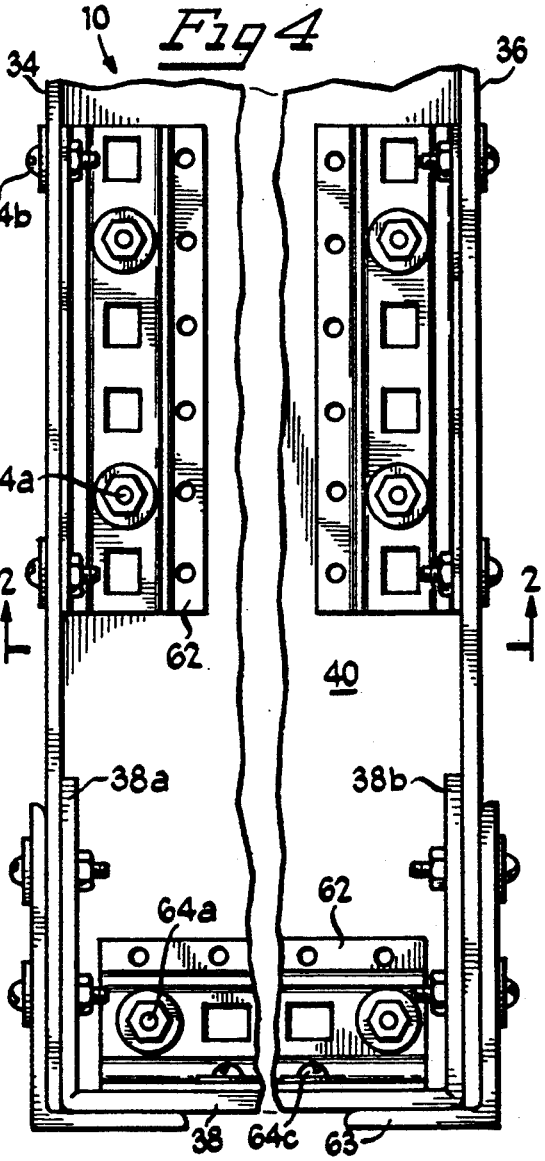
FIG. 4 is a broken back view of a section showing the inside surface of a section.

FIG. 4 is back view of section 10 showing the inside surface of a section. Layer of foam 40 is shown surrounded by side flaps 34, 36, and bottom flap 38 of the layer of corrugated 30. Side flaps 34 and 36 are shown mounted in assembled position by side bolts **64*b* mounted in angled metal stays 62 which, in turn, are mounted to foam layer 40 by elongated bolts 64*a*. Bottom flap 38 is shown mounted in assembled position by bottom bolts 64*c* mounted in angled metal stay 62 which, in turn, is mounted to foam layer 40 by elongated bolts 64*a*. Further, bottom flap 38 includes flap ends 38*a* and 38*b* which are folded up in juxtaposition with side flaps 34 and 36, respectively and are mounted thereto by side bolts 64*b*. Section 10 is shown mounted to angled metal brackets 63. However, angled metal brackets 63 should be understood to illustrate additional sections and/or a building base support 15**.

Figure 5:
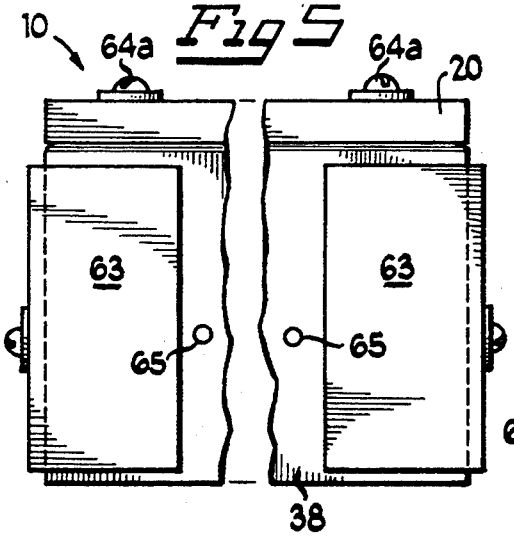
FIG. 5 is a broken bottom view of a section.

FIG. 5 shows a bottom view of section 10. Bottom flap 38 is seen including bolt ends 65 holding bottom flap 38 in its assembled position. Further seen in FIG. 5 is outer layer of gypsum board 20 having elongated bolts **64*a* therethrough. Bottom flap 38 is further illustrated as being mounted to angled metal brackets 63**.

FIG. 6 shows a side view of section 10. Outer layer of gypsum board 20 is secured by elongated bolts **64*a*. Side flap 34 is shown mounted in its assembled position perpendicular to outer layer of gypsum board 20 by side bolts 64*b***.

FIG. 7 is exploded perspective view of building section 10. As can be seen, outer layer of gypsum board 20 is laminated on main planar section 32 of corrugated layer 30, and foam layer 40 is laminated to the inner side of the main planar section 32 of corrugated layer 30 by any suitable adhesive means. These layers are secured by elongated bolts **64*a* mounted in angled metal stays 62 by main nuts 66*a*. Side flaps 34 and 36 of the layer of corrugated 30 fold inward along fold lines 34*a* and 36*a*, respectively until perpendicular with gypsum board 20 and foam layer 40. Side flaps 34 and 36 are held in assembled position by side bolts 64*b* mounted in angled metal stays 62 by side nuts 66b. Bottom flap 38 is folded inward and upward along fold line 37*a* until perpendicular with the outer layer of gypsum board 20, the main planar section 32 and the foam layer 40. Bottom flap 38 is held in assembled position by bottom bolt 64c mounted in angled metal stays 62. Further, end sections 38a and 38b (see FIG. 9) of bottom flap 38 are folded along fold lines 37b and 37c (See FIG. 9), respectively until perpendicular with outer layer of gypsum board 20, main planar section 32, layer foam 40 and bottom flap 38 and juxtaposed with side flaps 34 and 36, respectively. End sections 38a and 38b are then mounted to side flaps 34 and 36, respectively by side bolts 64b**.

FIG. 8 is a perspective view of section 10 in its partially assembled, pre-fabricated state in which outer layer of gypsum board 20, main planar section 32 and layer foam 40 are laminated together and secured by elongated bolts 64a. Side flaps 34, 36 and bottom flap 38 with end sections 38a and 38b remain unfolded until adjacent sections 10 are to be assembled during construction.

FIG. 9 is a top view of FIG. 8 showing outer layer of gypsum board 20, layer of corrugated 30 and layer of foam 40 laminated together. Side flaps 34 and 36 and bottom flap 38 with end sections 38a and 38b remain unfolded.

Figure 10:
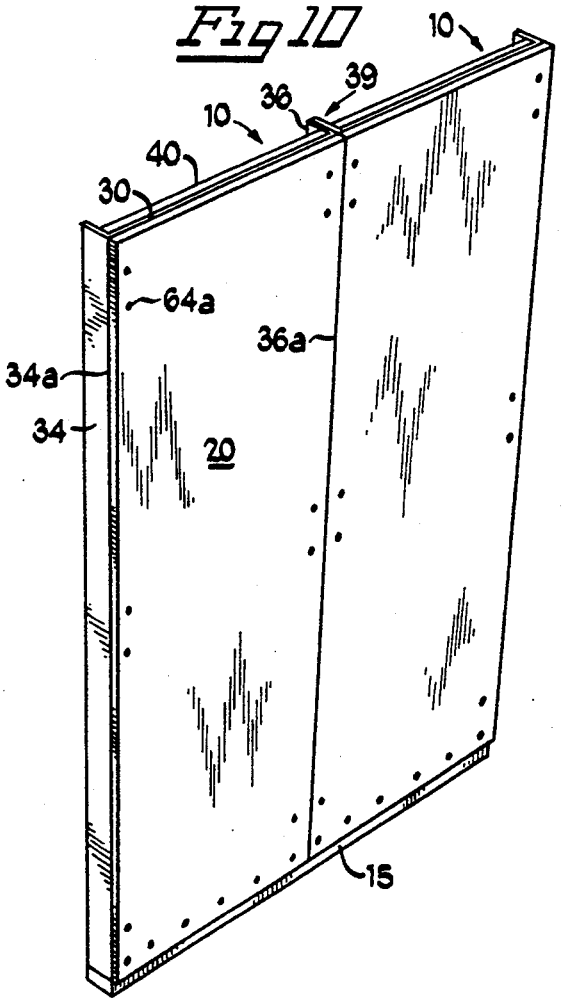
FIG. 10 is a perspective view of two sections mounted together as seen from the outside surface of the sections.

FIG. 10 is a perspective view as seen from the outside surface of section 10 with two sections 10 assembled to each other. As can be seen, the outer layer of gypsum board 20 is secured by elongated bolts 64a passing therethrough. Side flaps 34 and 36 of the layer of corrugated 30 are folded inward along fold lines 34a and 36a such that they are perpendicular with the gypsum board 20 and layer foam 40. Side flaps of adjacent building sections 10 are mounted together to form section stud 39. FIG. 10 further illustrates the two building sections 10 mounted to a building base support 15.

Figure 12:
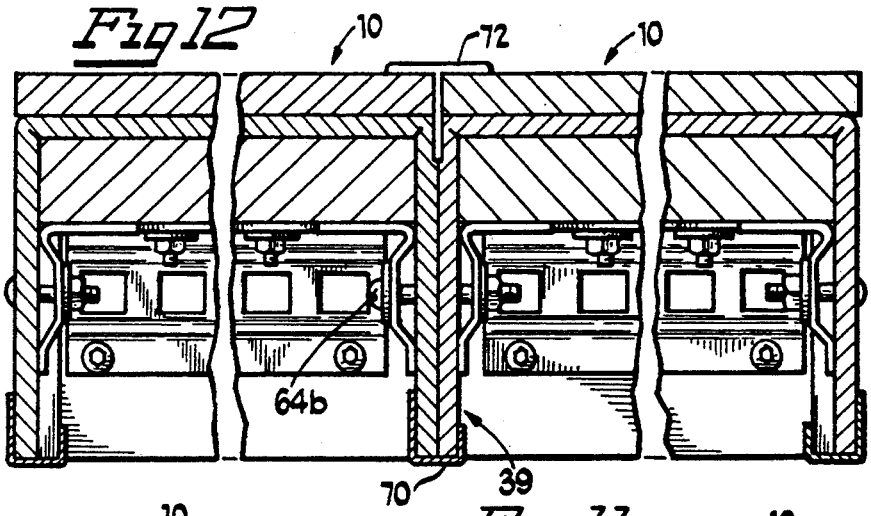
FIG. 12 is a broken top view of two sections mounted together.
Figure 11:
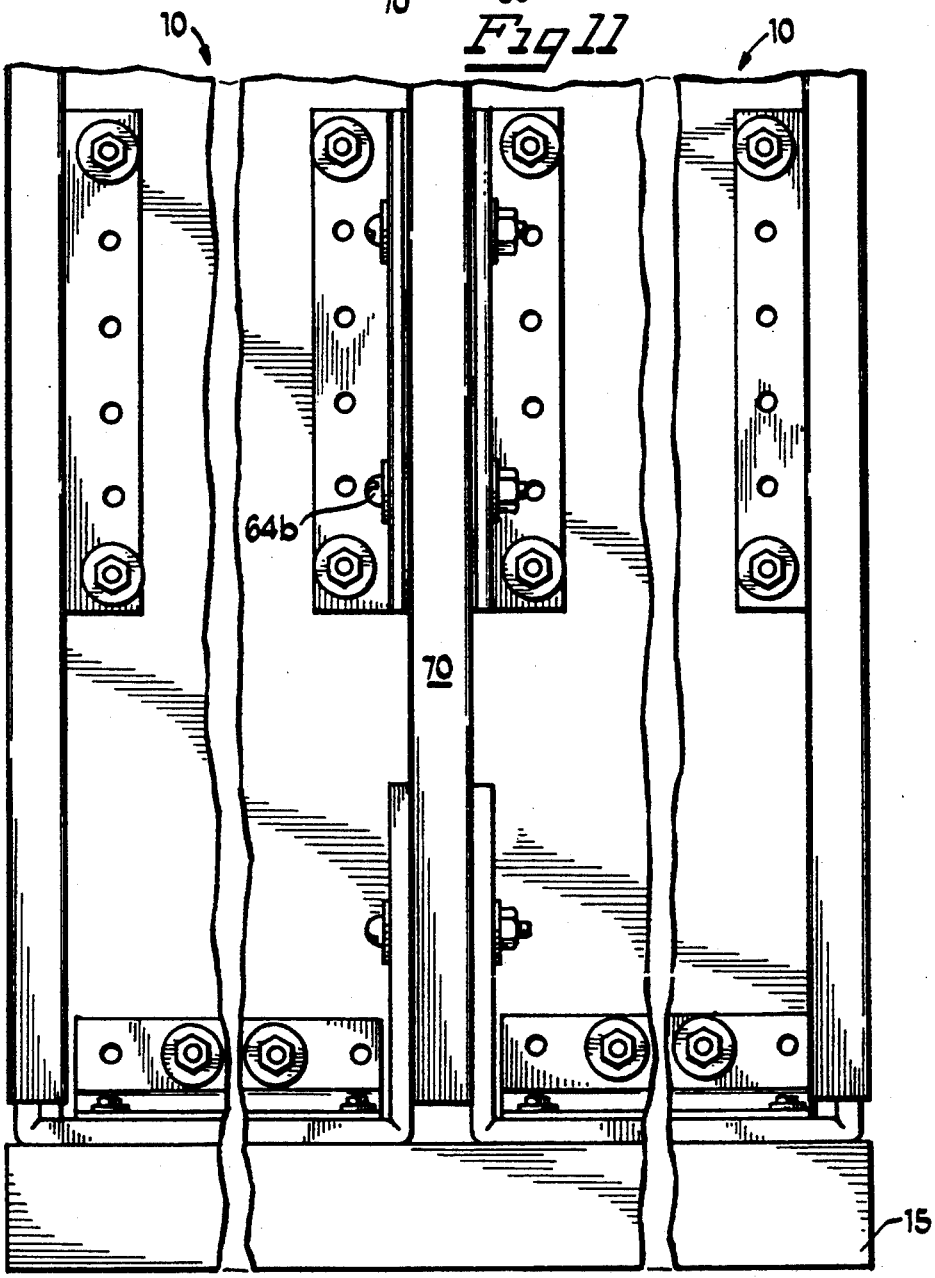
FIG. 11 is a broken back view of two sections mounted together as seen from the inside surface of the sections.

FIGS. 11–12 show a back view and a top view, respectively, of two sections 10 mounted together. As can be seen in FIG. 12, adjacent sides of each section 10 are mounted together by side bolts 64b to form section stud 39. Section stud 39 is covered with a J-shaped strip of plastic 70 running along the entire length of the section stud 39, as seen in FIG. 11. The two assembled sections 10 further include a strip of T-shaped plastic 72 placed between and partially covering gypsum boards 20 of the assembled section to form a seal therebetween.

FIG. 13 shows a cross-section of the second embodiment of the present invention wherein section 110 comprises an outer layer of gypsum board 120 laminated to a layer of corrugated 130, which is laminated to a layer of foam 140, which is laminated to an inner second layer of corrugated 150. Each layer of corrugated 130 and 150 comprises side flaps 134, 136, 154 and 156, respectively. Side flaps 134 and 136 are folded outward around the outer layer of gypsum board 120 until perpendicular to the outer layer of gypsum board 120. Side flaps 154 and 156 of the outer layer of corrugated 150 are folded outward around the foam layer 140 until perpendicular with the foam layer 140 and juxtapositioned with the flaps 134 and 136.

Building section 110 is preferably used as a roofing section. Flaps 134 and 154 and flaps 136 and 156 when mounted adjacent an additional section 110, form a section stud between which a T-shaped section of plastic 172 (See FIG. 14) is placed to seal the adjacent sections.

FIG. 14 shows an exploded perspective view of the embodiment of FIG. 13 wherein outer layer of gypsum board 120 is laminated to a layer of corrugated 130 having flaps 134 and 136, a layer of foam 140 and a second inner layer of corrugated 150 having flaps 154 and 156. The layer of gypsum board 120, layer of corrugated 130, layer of foam 140, and second layer of corrugated 150 are laminated or glued together and secured by elongated bolts 164a mounted through angled metal stays 162. Sides 134 and 154 are held in mounted position by side bolts 164b mounted through angled metal stays 162. Similarly, side flaps 136 and 156 are held in assembled position by side bolts 164b mounted through angled metal stays 162. T-shaped section 172 mounts between and over side flaps of adjacent sections 110.

Before construction, the interior and exterior surfaces of sections 10 and 110, including the corrugated flaps, are coated with a fire-retardant material (i.e. paint) to make sections 10 and 110 completely fireproof and prevent spontaneous combustion. Fire resistancy is preferably obtained by the use of Tough/Coat fire resisting paints, manufactured by Space Age Technology Products, Inc. of Chicago, Ill., used as a primer coat for the corrugated material. The Tough/Coat paints also give a water-resistancy to and strengthen and stiffen the corrugated material.

All building sections will be pre-drilled to allow for simple and fast construction. The sections of the present invention can be cut to accommodate windows, doors, etc. The layers of the present invention can be fastened together in any suitable manner. Preferably, the layers are laminated or glued to one another by any suitable adhesive means, prior to the drilling of holes for fasteners 60, 160.

The sections 10, 110 can be used in the construction of building or other structures. Construction using sections 10, 110 is fast, safe and efficient and can be achieved at a far less expense than present construction material. Sections 10, 110 could be any shape or size but preferably are two foot wide panels with a length approximately that of a wall board or plaster board.

Construction of section 10 is as follows. Layer of corrugated material 30 is completely painted with fire resisting paint. Layer of gypsum board 20 is juxtapositioned with main planar section 32 on one side of corrugated layer 30 and laminated thereto. Layer of foam 40 is juxtapositioned with main planar section 32 on the other side of corrugated layer 30 and laminated thereto. Holes for fasteners 60 are then drilled through layers 20, 30, and 40. To attach two sections together, corrugated flaps 34, 36 and 38 are folded along their respective fold lines as described above. The two sections are then placed side by side and the respective juxtapositioned side flaps are fastened together by side bolts 64b. Bottom flap 38 is anchored to building support 15 by bottom bolts 64c.

Construction of section 110 is as follows. Layers of corrugated material 130 and 150 are completely painted with fire resisting paint. One side of foam layer 140 is juxtapositioned with and laminated to the main planar section of corrugated layer 150. The other side of foam layer 140 is juxtapositioned with and laminated to one side of the main planar section of corrugated layer 130. Gypsum board 120 is juxtapositioned with and laminated to the other side of the main planar section of corrugated layer 130. Holes for fasteners 60 are then drilled through layer 120, 130, 140 and 150. To attach two sections together, corrugated flaps 134, 136, 138, 154 and 156 are folded as described above. The two sections are then placed side by side and the respective juxtapositioned side flaps are fastened together by side bolts **164*b***.

It is to be understood that the embodiments herein described are merely for illustrative of the principles of the present invention. Various modifications may be made by those skilled in the art without departing from the spirit or scope of the claims which follow.

I claim:

1. A structural member comprising:

a rigid fire-retardant layer;

a layer of corrugated material having a main planar surface and two substantially identical side flaps, said main planar surface being juxtapositioned with and attached to said fire-retardant layer, said side flaps extending a short distance from said main planar surface and being positioned perpendicular to said fire retardant layer to form structural studs of a substantially C-shaped building member;

a layer of foam material juxtapositioned with and attached to said layer of corrugated material, opposite said fire-retardant layer; and a plurality of fasteners for holding said side flaps in position, said side flaps solely constituting said structural studs when held position with said fasteners, said fasteners being L-shaped angled metal stays comprising a first flange and a second flange, said first flange being fastened to a side flap and said second flange being fastened to said layer of foam material.

2. The structural member of claim 1, wherein said fire-retardant layer is gypsum board.

3. The structural member of claim 1, wherein said fire-retardant layer, said layer of corrugated material, and said layer of foam material are laminated together.

4. The structural member of claim 1, wherein said layer of corrugated material is corrugated cardboard.

5. The structural member of claim 1, wherein said layer of corrugated material is coated with fire resisting paint.

6. A pre-fabricated, fire-resistant structural member for use in constructing wood-less structures having a base support, said structural member comprising:

a layer of gypsum board;

a layer of corrugated cardboard having a main planar surface and two substantially identical side flaps, said main planar surface being juxtapositioned with and attached to said gypsum board, said side flaps extending a short distance from said main planar surface and being positioned perpendicular to said gypsum board to form structural studs of a substantially C-shaped building member;

a layer of foam material juxtapositioned with and attached to said layer of cardboard, opposite said layer of gypsum board;

means for securing said structural member in an assembled position, said means for securing being L-shaped metal stays comprising a first flange and a second flange, said first flange being fastened to a side flap and said second flange being fastened to said member via fasteners; and said side flaps positioned perpendicular to and around said layer of foam material to independently form said structural studs when secured in said assembled position.

7. The structural member of claim 6, wherein said cardboard is coated with fire resisting paint.

8. The structural member of claim 6, wherein said layer of corrugated cardboard further includes a bottom flap, said bottom flap extending a short distance away from said main planar surface and being positioned perpendicular to said layer of foam material and said side flaps, said bottom flap being held in position by said means for securing, said structural member being mounted to said base support via said bottom flap.

9. A method of construction comprising the steps of:

providing a rigid fire-retardant layer;

juxtapositioning and attaching a layer of corrugated material having a main planar surface and substantially identical side flaps to said fire-retardant layer;

juxtapositioning and attaching a layer of foam material to said layer of corrugated material, opposite said fire-retardant layer;

positioning said side flaps of said corrugated material perpendicular to and around said layer of foam material to form a C-shaped member, said side flaps forming independent structural studs of said C-shaped member; and securing said fire-retardant layer, said main planar surface, said layer of foam material, and said side flaps in an assembled position with L-shaped metal flanges.

10. The method of construction of claim 9, wherein said layer of corrugated material further includes a bottom flange, said method further comprising the steps of:

positioning said bottom flange of said corrugated material perpendicular to and around said layer of foam material and perpendicular to said side flaps; and securing said bottom flange in position via L-shaped metal stays.

* * * * *